US005431034A

United States Patent [19]

Fann et al.

[11] Patent Number: 5,431,034

[45] Date of Patent: Jul. 11, 1995

[54] CYLINDER LOCK WITH REMOVABLE AND REPLACEABLE KEY PLUG

[75] Inventors: Yaw-Shin Fann; Ming-Shyng Chiou, both of Chiayi City, Taiwan

[73] Assignee: Tong-Lung Metal Industry Co., Ltd., Chiayi City, Taiwan

[21] Appl. No.: 125,912

[22] Filed: Sep. 23, 1993

[51] Int. Cl.[6] ..... E05B 27/04

[52] U.S. Cl. ..... 70/369; 70/337; 70/493; 70/375; 70/421

[58] Field of Search ..... 70/375, 371, 379 R, 70/379 A, 380, 337, DIG. 37, 358, 419, 421, 367–369, 493, 382

[56] References Cited

U.S. PATENT DOCUMENTS

| | | | |
|---|---|---|---|
| Re. 31,910 | 6/1985 | Oliver | 70/369 |
| 415,178 | 11/1889 | Taylor | 70/337 |
| 1,233,733 | 7/1917 | Voight | 70/337 |
| 1,788,834 | 1/1931 | Hurd | 70/337 |
| 1,832,108 | 11/1031 | Falk | 70/369 |
| 1,855,607 | 4/1932 | Lyons | 70/369 |
| 1,964,787 | 7/1934 | Voight | 70/369 |
| 1,986,676 | 1/1935 | Hurd | 70/369 |
| 2,247,621 | 7/1941 | Speer | 70/421 |
| 2,481,093 | 9/1949 | Dyson | 70/369 |
| 4,194,379 | 3/1980 | Dice, Sr. | 70/421 |

FOREIGN PATENT DOCUMENTS

| | | | |
|---|---|---|---|
| 1160518 | 9/1969 | United Kingdom | 70/453 |

*Primary Examiner*—Lloyd A. Gall
*Attorney, Agent, or Firm*—Ladas & Parry

[57] ABSTRACT

A cylinder lock includes a lock shell which confines a cylindrical hole and a rotatable cylindrical key plug provided within the hole of the lock shell and formed with a longitudinally extending keyway. The key plug is further formed with a plurality of first bores which receive a lower tumbler pin of a respective first tumbler set, while the lock shell is further formed with a plurality of second bores which receive an upper tumbler pin of a respective first tumbler set. A plug retaining sleeve has a front portion which extends into the hole of the lock shell and which confines a hollow space for receiving a rear portion of the key plug. The rear portion of the key plug and the front portion of the plug retaining sleeve are respectively formed with third and fourth radially aligned bores which receive a lower tumbler pin of a second tumbler set.

16 Claims, 7 Drawing Sheets

CYLINDER LOCK WITH REMOVABLE AND REPLACEABLE KEY PLUG

BACKGROUND OF THE INVENTION

1. Field of the Invention

The invention relates to a cylinder lock, more particularly to a cylinder lock with a removable and replaceable key plug.

2. Description of the Related Art

Cylinder locks are usually installed in door knobs and the like. A main drawback of conventional cylinder locks is that it is necessary to disassemble the door knob when it is desired to replace the conventional cylinder lock.

SUMMARY OF THE INVENTION

Therefore, the objective of the present invention is to provide a cylinder lock which is capable of overcoming the above mentioned drawback that is commonly associated with conventional cylinder locks.

More specifically, the objective of the present invention is to provide a cylinder lock with a removable and replaceable key plug.

Another objective of the present invention is to provide a cylinder lock which requires the use of a first key to unlock the same and a second key to remove the key plug.

A further objective of the present invention is to modify slightly the construction of a standard cylinder lock in order to permit removal and replacement of the key plug of the same.

Accordingly, the cylinder lock of the present invention comprises:

a plurality of first tumbler sets, each of which including a lower tumbler pin and an upper tumbler pin;

a lock shell confining a cylindrical hole and having a front end and a rear end;

a rotatable cylindrical key plug provided within the hole of the lock shell via the front end of the lock shell and formed with a longitudinally extending keyway, the key plug having front and rear portions and being formed with a plurality of first bores which receive the lower tumbler pin of a respective one of the first tumbler sets, the first bores having axes which are substantially normal to an axis of the key plug;

the lock shell being formed with a plurality of second bores which receive the upper tumbler pin of a respective one of the first tumbler sets, each of the second bores being aligned with a respective one of the first bores;

each of the first tumbler sets further including a biasing spring for forcing the upper tumbler pin into a respective one of the first bores and for forcing the lower tumbler pin into the keyway to prevent rotation of the key plug relative to the lock shell;

a plug retaining sleeve having a front portion and a rear portion, the front portion of the plug retaining sleeve extending into the hole of the lock shell via the rear end of the lock shell and confining a hollow space for receiving the rear portion of the key plug;

the rear portion of the key plug and the front portion of the plug retaining sleeve being respectively formed with third and fourth radially aligned bores; and a second tumbler set having a lower tumbler pin received in the third and fourth bores.

The cylindrical lock further comprises a first key which is capable of activating the first and second tumbler sets so as to permit simultaneous rotation of the key plug and the plug retaining sleeve when operated, and a second key which is capable of activating the first and second tumbler sets so as to permit rotation of the key plug relative to the plug retaining sleeve when operated.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
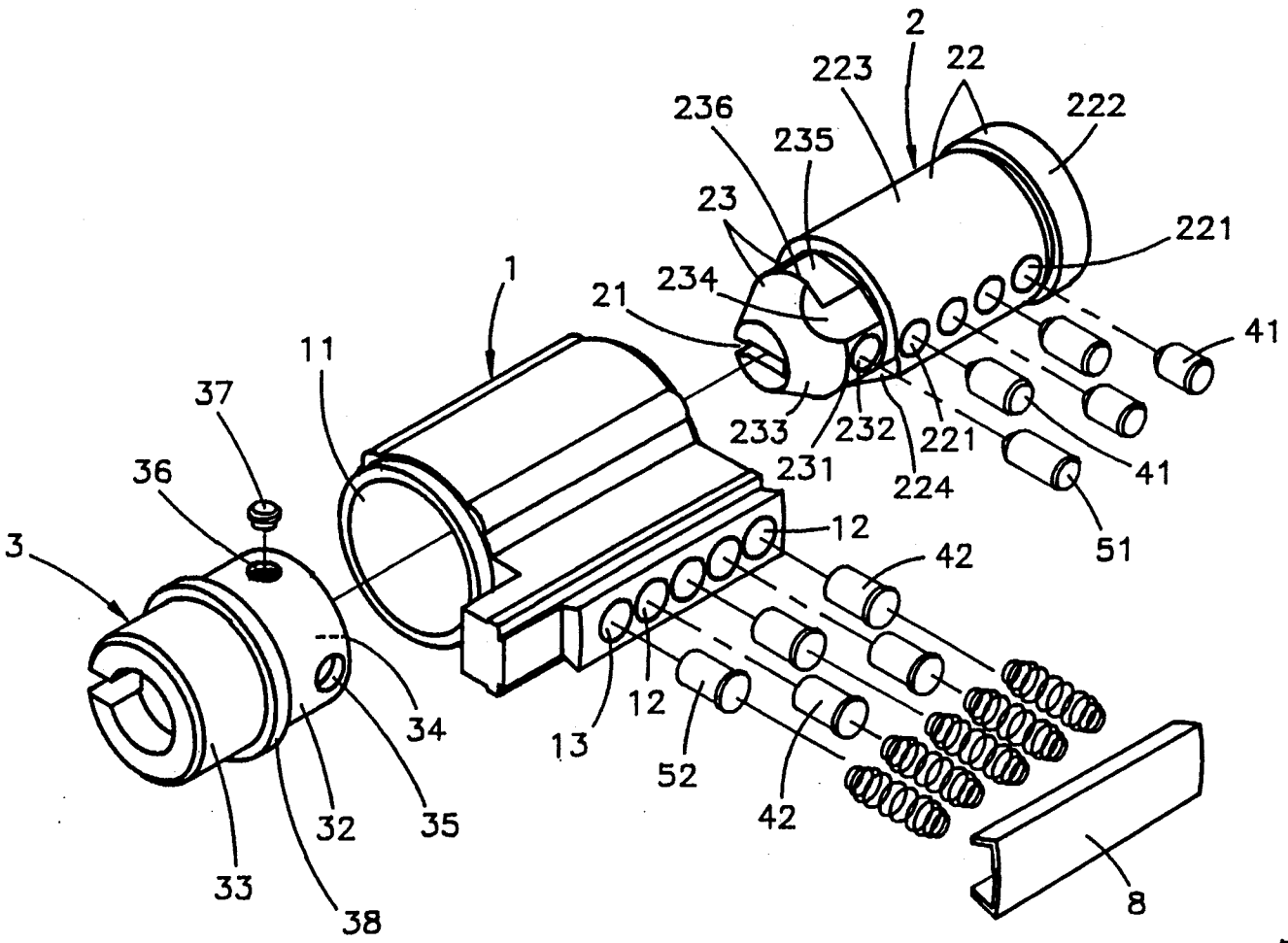
FIG. 1 is an exploded view of the first preferred embodiment of a cylinder lock with a removable and replaceable key plug according to the present invention.

Referring to FIGS. 1 to 6, the first preferred embodiment of a cylinder lock according to the present invention is shown to comprise a lock shell 1, a cylindrical key plug 2, a plug retaining sleeve 3, a first key 6 and a second key 7.

The lock shell 1 is formed with a cylindrical hole 11 to receive portions of the key plug 2 and the plug retaining sleeve 3. The key plug 2 is formed with a longitudinally extending keyway 21 that is adapted to receive the first and second keys 6, 7 therein. The key plug 2 is formed with a plurality of first bores 221 which receive a lower tumbler pin 41 of a respective first tumbler set and which have axes that are substantially normal to the axis of the key plug 2. The lock shell 1 is formed with a plurality of second bores 12 which receive an upper tumbler pin 42 of a respective first tumbler set and which are aligned with a respective one of the first bores 221. The first tumbler sets further comprise biasing springs for forcing the upper tumbler pins 42 into the first bores 221 and for forcing the lower tumbler pins 41 into the keyway 21 so as to prevent rotation of the key plug 2 relative to the lock shell 1. When inserted, each of the first and second keys 6, 7 is capable of moving the lower tumbler pins 41 to force the upper tumbler pins 42 out of the first bores 221 to permit rotation of the key plug 2 relative to the lock shell 1.

The plug retaining sleeve 3 is formed with an axially extending key groove 31 that communicates with the keyway 21 of the key plug 2. The plug retaining sleeve 3 has a front portion 32 that confines a hollow space 34 for receiving the rear portion 23 of the key plug 2 therein. The key plug 2, the plug retaining sleeve 3 and the lock shell 1 are respectively formed with third, fourth and fifth radially aligned bores 232, 35, 13 which receive lower and upper tumbler pins 51, 52 and the biasing spring of a second tumbler set. A cover plate 8 is provided on the lock shell 1 to prevent the untimely removal of the first and second tumbler sets via the second and fifth bores 12, 13 of the lock shell 1.

The front portion 22 of the key plug 2 is formed with a first cylindrical section 222 and a second cylindrical section 223 which extends from the first cylindrical section 222 and which has a diameter that is smaller than that of the first cylindrical section 222. The rear portion 23 of the key plug 2 is formed with a third cylindrical section 231 and a tapered section 233 which extends from the third cylindrical section 231. The third cylindrical section 231 extends from the second cylindrical section 223 and has a diameter which is smaller than that of the second cylindrical section 223. The second cylindrical section 223 is formed with an inclined face 224 adjacent to the third cylindrical section 231. The inclined face 224 serves to push the upper tumbler pins 42, 52 into the bores 12, 13 of the lock shell 1 when the key plug 2 is inserted into the latter.

The cylindrical section 231 of the rear portion 23 is formed with a radial notch 235 with a flat bottom and an inclined flat face 234 which extends from one side of the flat bottom of the radial notch 235. A limiting wall portion 236 is disposed on one end of the radial notch 235 opposite the second cylindrical section 223.

The plug retaining sleeve 3 is formed with an annular peripheral flange 38 between the front and rear portions 32, 33 of the sleeve. The front portion 32 of the plug retaining sleeve 3 is formed with a radial hole 36 for retaining a positioning pin 37 therein. The positioning pin 37 abuts against one of the flat bottom of the radial notch 235 and the inclined flat face 234 to limit rotation of the key plug 2 relative to the plug retaining sleeve 3. During normal conditions, the positioning pin 37 extends into the radial notch 235, and the limiting wall portion 236 cooperates with the positioning pin 37 to prevent relative axial movement between the key plug 2 and the plug retaining sleeve 3.

Figure 2:
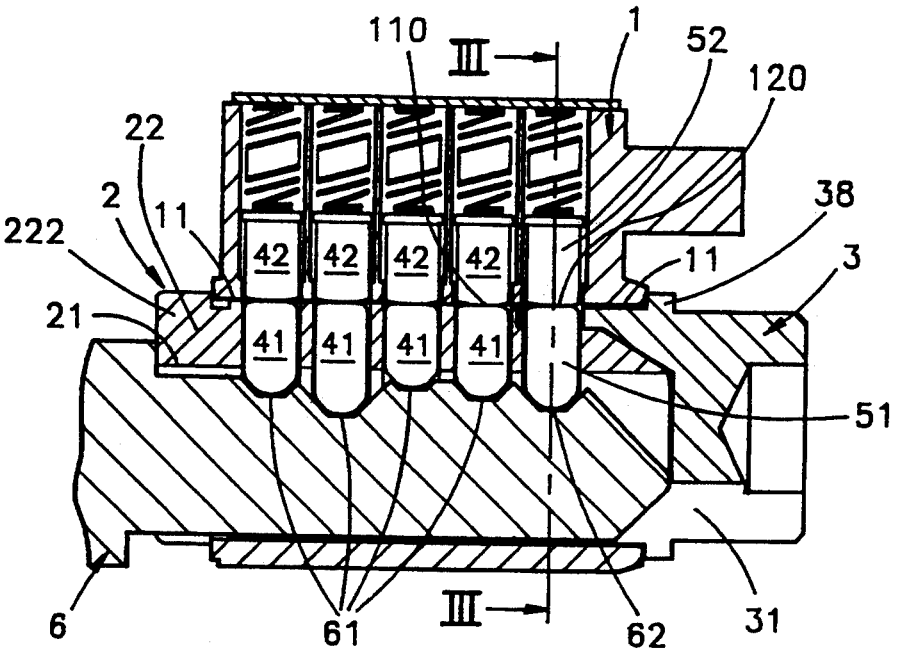
FIG. 2 is a longitudinal sectional view illustrating the first preferred embodiment when inserted with a first key for unlocking the same.
Figure 3:
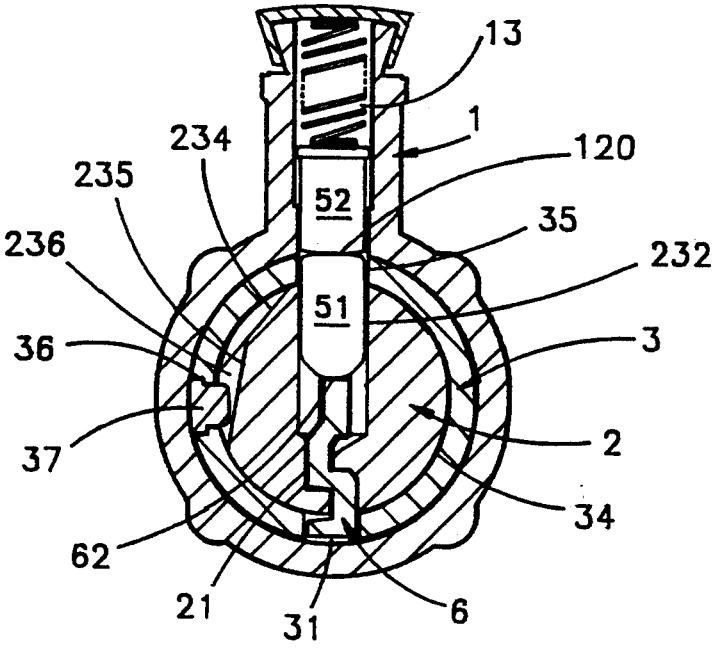
FIG. 3 is a sectional view of the first preferred embodiment taken along line III—III in FIG. 2.

Referring to FIGS. 2 and 3, when the key plug 2 and the plug retaining sleeve 3 are inserted into the cylindrical hole 11 of the lock shell 1, the first cylindrical section 222 of the front portion 22 of the key plug 2 and the annular peripheral flange 38 on the plug retaining sleeve 3 respectively abut against front and rear end surfaces of the lock shell 1. FIG. 2 illustrates the first preferred embodiment when the first key 6 is inserted into the keyway 21. The first key 6 has a longitudinal portion which extends into the key groove 31 of the plug retaining sleeve 3 and further has a tumbler activating edge which is formed with a plurality of first key bit grooves 61 for activating the first tumbler sets and a second key bit groove 62 for activating the second tumbler set. When the first key 6 is in use, the mating planes 110 of the lower and upper tumbler pins 41, 42 of the first tumbler sets lie on the junction of the lock shell 1 and the key plug 2, while the mating plane 120 of the lower and upper tumbler pins 51, 52 of the second tumbler set lie on the junction of the lock shell 1 and the plug retaining sleeve 3. Therefore, the key plug 2 and the plug retaining sleeve 3 can rotate simultaneously with the first key 6 relative to the lock shell 1 so as to unlock the cylinder lock of the present invention when the first key 6 is operated.

Figure 4:
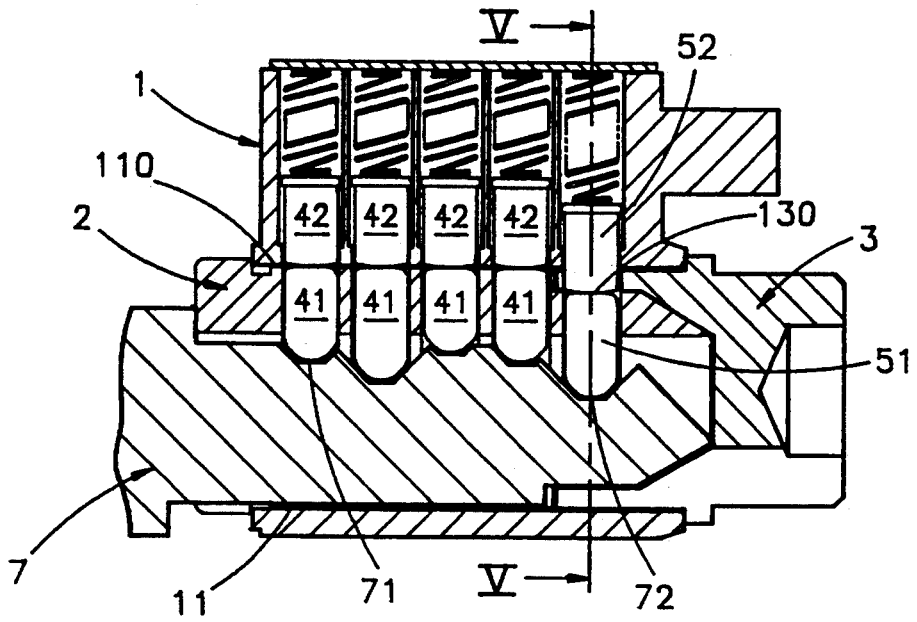
FIG. 4 is a longitudinal sectional view illustrating the first preferred embodiment when inserted with a second key for removing the key plug thereof.
Figure 5:
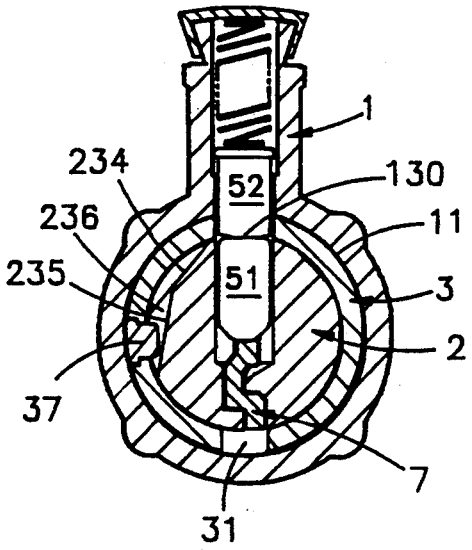
FIG. 5 is a sectional view of the first preferred embodiment taken along line V—V in FIG. 4.
Figure 6:
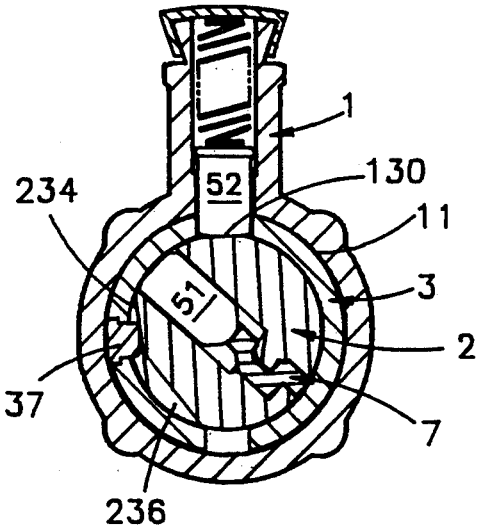
FIG. 6 is a sectional view of the first preferred embodiment illustrating the key plug thereof after being rotated by a predetermined angle with the use of the second key so as to remove the same.

FIGS. 4 and 5 illustrate the first preferred embodiment when the second key 7 is inserted into the keyway 21. Unlike the first key 6, the second key 7 does not extend into the key groove 31 of the plug retaining sleeve 3. The second key 7 has a tumbler activating edge which is formed with a plurality of first key bit grooves 71 for activating the first tumbler sets and a second key bit groove 72 for activating the second tumbler set. When the second key 7 is in use, the mating planes 110 of the lower and upper tumbler pins 41, 42 of the first tumbler sets lie on the junction of the lock shell 1 and the key plug 2, while the mating plane 130 of the lower and upper tumbler pins 51, 52 of the second tumbler set lie on the junction of the key plug 2 and the plug retaining sleeve 3. Therefore, when the second key 7 is rotated in a counterclockwise direction by a predetermined angle, the key plug 2 rotates therewith relative to the plug retaining sleeve 3 and the lock shell 1, as shown in FIG. 6. At this stage, the positioning pin 37 on the plug retaining sleeve 3 abuts against the inclined flat face 234 instead of the flat bottom of the radial notch 235. In addition, the limiting wall portion 236 ceases to restrict axial movement of the key plug 2 past the positioning pin 37 so as to permit removal of the key plug 2 from the lock shell 1 when the second key 7 is extracted from the latter. A new key plug 2 with a different set of lower tumbler pins 41, 51 can then be inserted into the cylindrical hole 11 of the lock shell 1 by performing the above steps in a reverse order with the use of a corresponding new second key 7.

Note that although a second key 7 is used to remove and replace the key plug 2 in the above described embodiment, it is also possible to achieve the same function by simply modifying the configuration of the first key 6.

Figure 7:
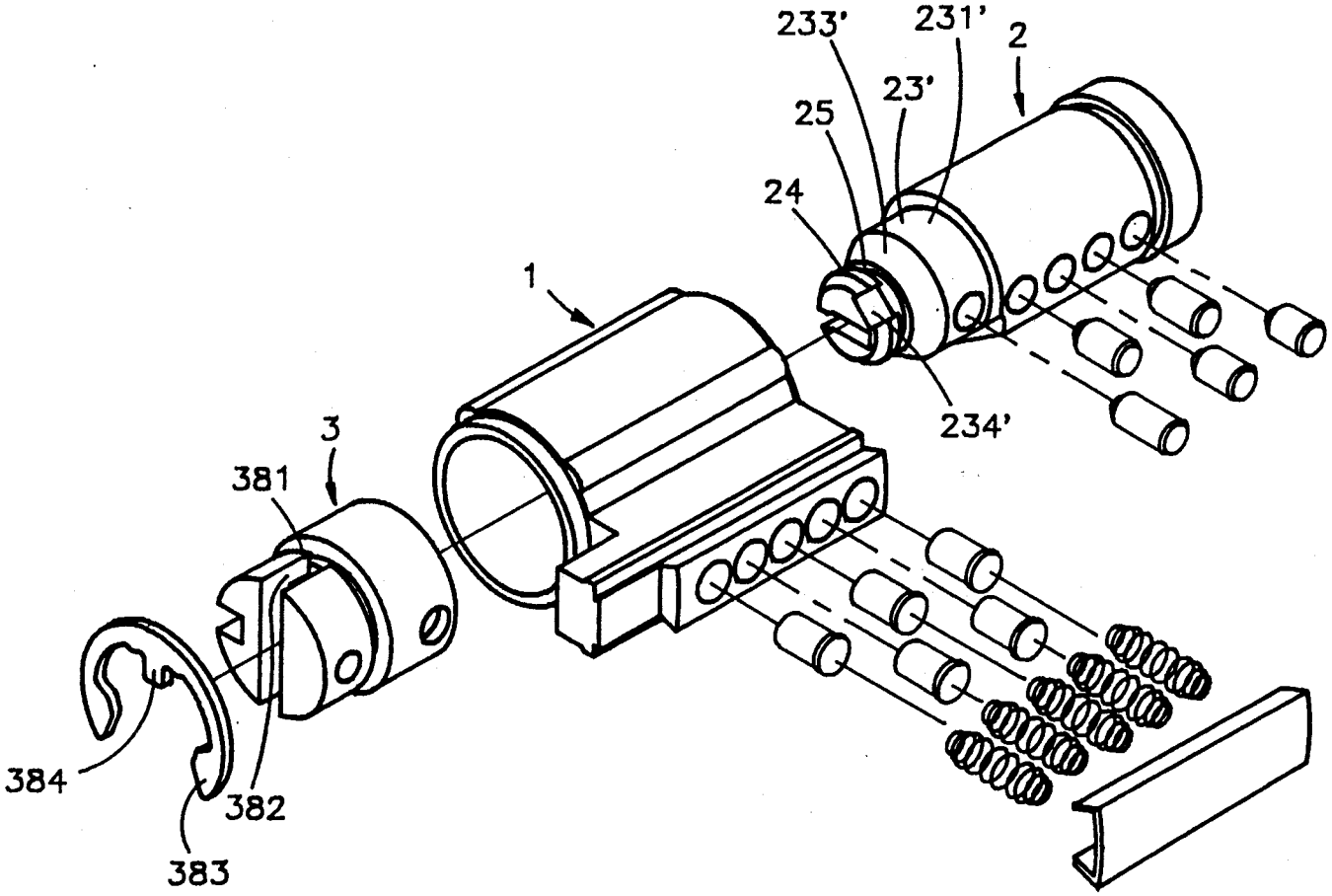
FIG. 7 is an exploded view of the second preferred embodiment of a cylinder lock with a removable and replaceable key plug according to the present invention.
Figure 8:
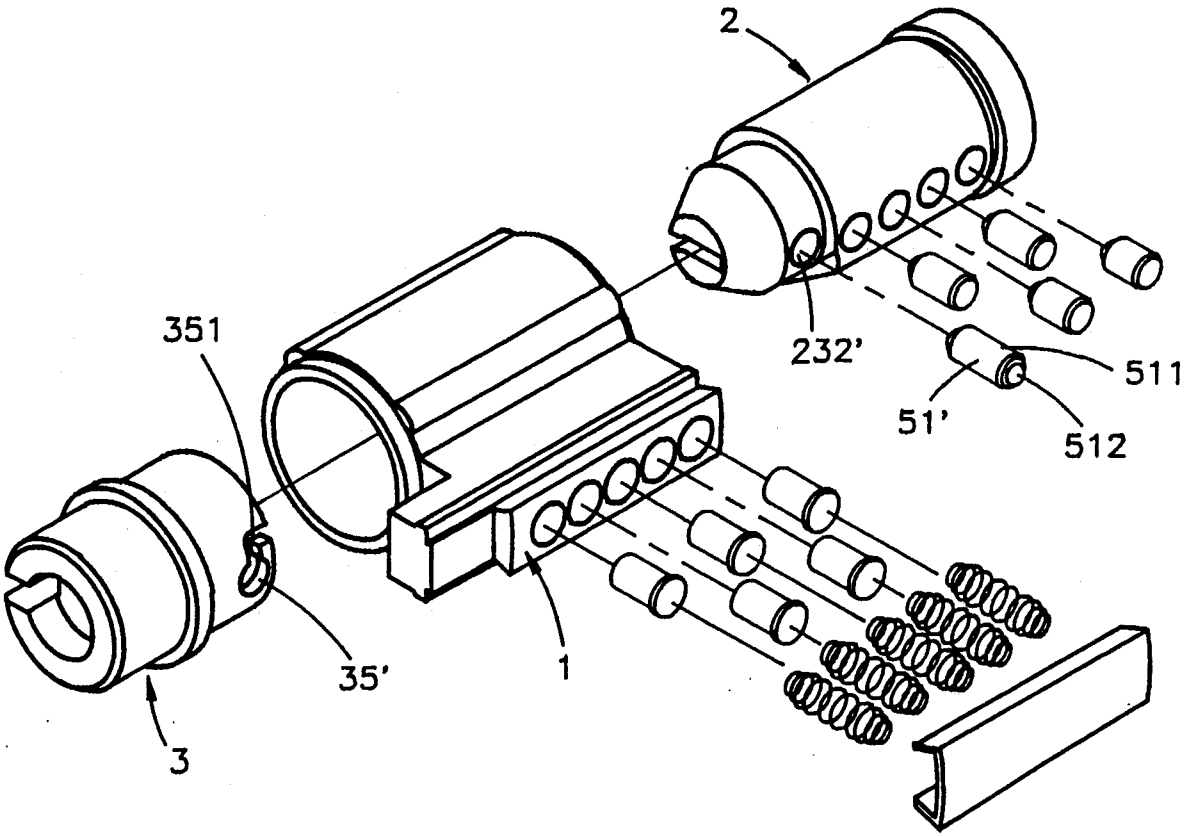
FIG. 8 is an exploded view of the third preferred embodiment of a cylinder lock with a removable and replaceable key plug according to the present invention.

Referring to FIG. 7, the second preferred embodiment of a cylinder lock according to the present invention is shown to be substantially similar to the first preferred embodiment. However, unlike the first preferred embodiment, the cylindrical section 231' of the rear portion 23' of the key plug 2 of the second preferred embodiment is not formed with an inclined flat face and a radial notch. Instead, the rear portion 23' of the key plug 2 further includes a fourth cylindrical section 24 which extends axially from the tapered section 233'. The fourth cylindrical section 24 is formed with an annular peripheral groove 25 adjacent to the tapered section 233', and an axially extending peripheral notch 234' which communicates with the peripheral groove 25.

Note also that, unlike the first preferred embodiment, the plug retaining sleeve 3 of the second preferred embodiment is not provided with a radial hole, a positioning pin or an annular peripheral flange. Instead, the rear portion of the plug retaining sleeve 3 is formed with a diametrically extending slit 382 and an annular positioning groove 381 which is connected to the slit 382. The cylinder lock further comprises a C-shaped locking ring 383 which is formed with an inward projection 384. The locking ring 383 is mounted in the positioning groove 381 such that the inward projection 384 extends into the slit 382.

During assembly, the key plug 2 and the plug retaining sleeve 3 are inserted into the lock shell 1 such that the inward projection 384 extends into the peripheral groove 25 via the peripheral notch 234'. The key plug 2 is then rotated relative to the plug retaining sleeve 3, thereby securing rotatably the key plug 2 and the plug retaining sleeve 3 to the lock shell 1. The key plug 2 can be removed from the lock shell 1 only when the inward projection 384 is aligned with the peripheral notch 234'.

The construction and operation of the remaining parts of the second preferred embodiment are substantially similar to those of the previous embodiment and will not be detailed further.

FIGS. 8 to 11 illustrate the third preferred embodiment of a cylinder lock according to the present invention. Unlike the first preferred embodiment, the rear portion of the key plug 2 of the third preferred embodiment is not formed with an inclined flat face and a radial notch. In addition, the plug retaining sleeve 3 of the third preferred embodiment is not provided with a radial hole, a positioning pin or an annular peripheral flange. Instead, the front portion of the plug retaining sleeve 3 is formed with an L-shaped notch 351 to access the fourth bore 35'. Moreover, the lower tumbler pin 51' of the second tumbler set has a shank 511 and a convex hemispherical protrusion 512 formed on one end of the shank 511.

Figure 9:
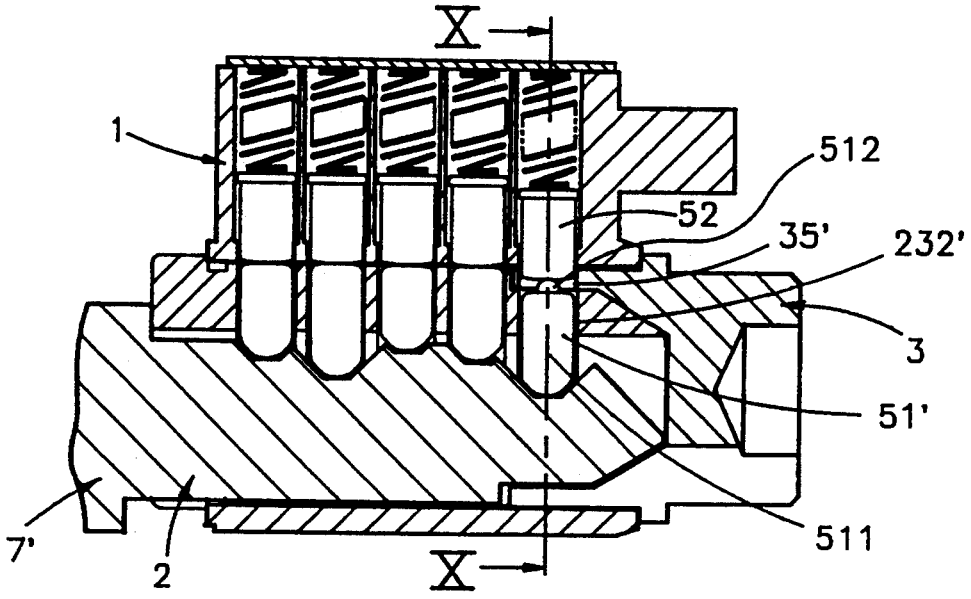
FIG. 9 is a longitudinal sectional view illustrating the third preferred embodiment when inserted with a key for removing the key plug thereof.
Figure 10:
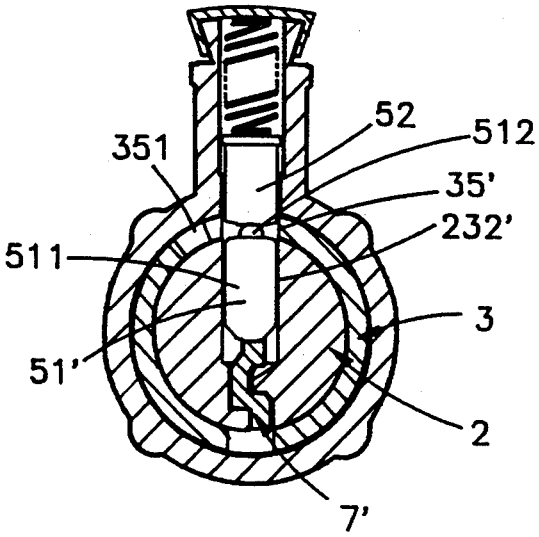
FIG. 10 is a sectional view of the third preferred embodiment taken along line X—X in FIG. 9.
Figure 11:
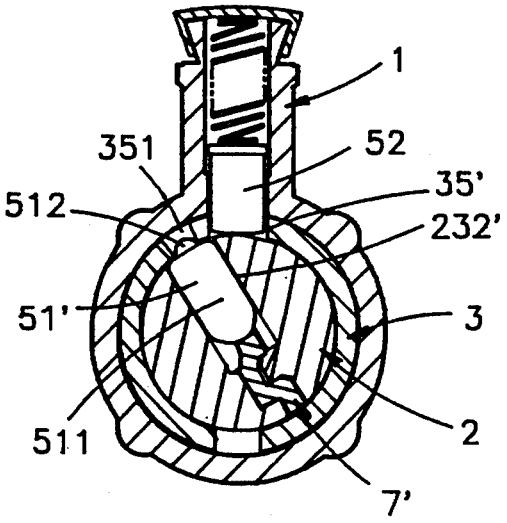
FIG. 11 is a sectional view of the third preferred embodiment illustrating the key plug thereof after being rotated by a predetermined angle so as to remove the latter.

Referring to FIGS. 9 and 10, when the second key 7' is inserted into the keyway of the key plug 2, the tip of the upper tumbler pin 52 of the second tumbler set extends into the fourth bore 35' in the plug retaining sleeve 3, the shank 511 of the lower tumbler pin 51' extends fully into the third bore 232' in the key plug 2, while the convex protrusion 512 extends into the fourth bore 35'. Referring to FIG. 11, after the second key 7' has been operated so as to rotate the key plug 2 relative to the plug retaining sleeve 3, the convex protrusion 512 moves from the fourth bore 35' so as to extend into the L-shaped notch 351. Once the convex protrusion 512 reaches the leftmost end of the L-shaped notch 351, further relative rotation between the key plug 2 and the plug retaining sleeve 3 is prevented. At this stage, the key plug 2 is removed from the lock shell 1 when the second key 7' is extracted from the latter.

The construction and operation of the remaining parts of the third preferred embodiment are substantially similar to those of the previous embodiments and will not be detailed further.

Figure 12:
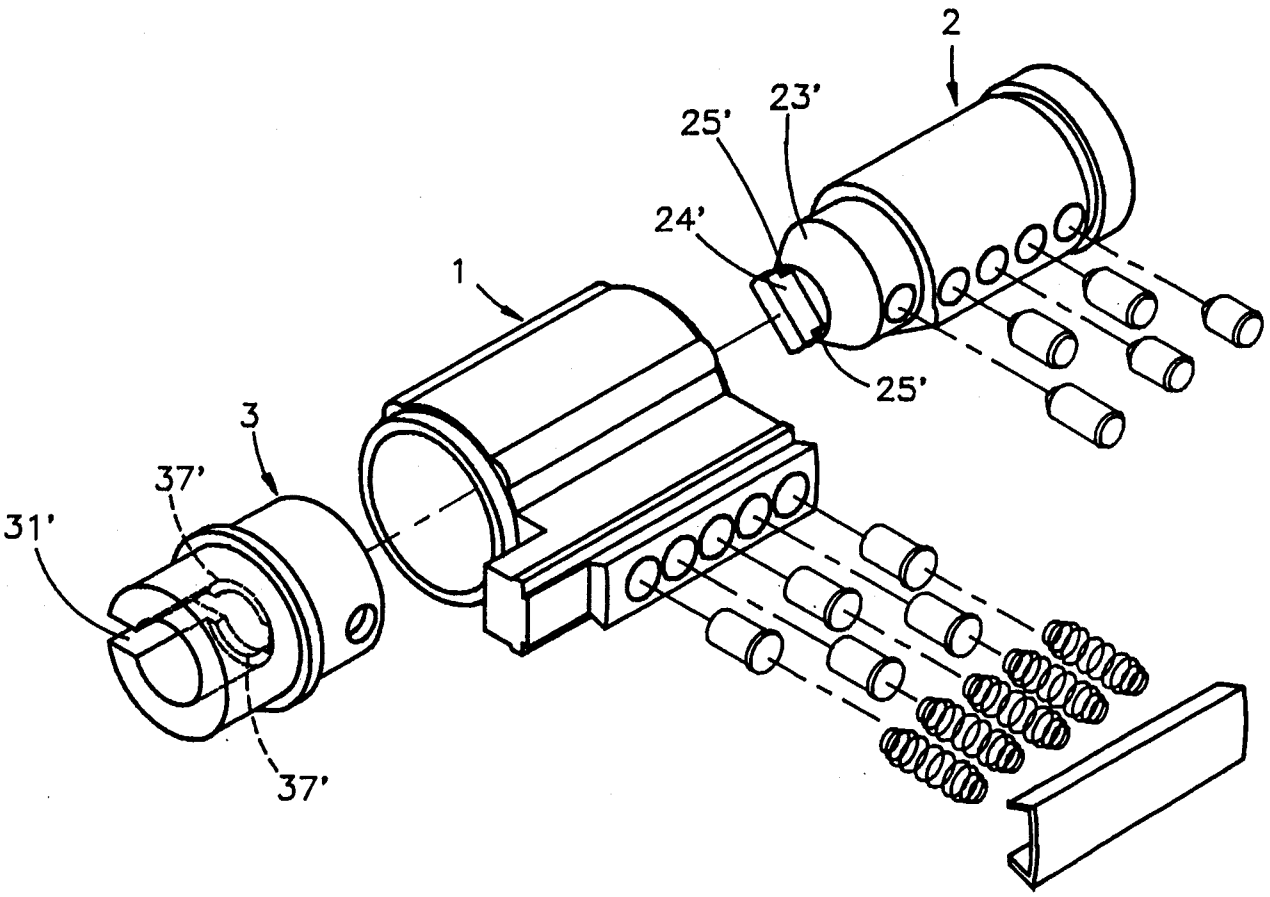
FIG. 12 is an exploded view of the fourth preferred embodiment of a cylinder lock with a removable and replaceable key plug according to the present invention.

FIG. 12 illustrates the fourth preferred embodiment of a cylinder lock according to the present invention. Unlike the first preferred embodiment, the rear portion of the key plug 2 of the fourth preferred embodiment is not formed with an inclined flat face and a radial notch. In addition, the plug retaining sleeve 3 of the fourth preferred embodiment is not provided with a radial hole for receiving a positioning pin therein. Instead, the rear portion of the key plug 2 is provided with an axially extending retaining flange 24' which extends from the tapered section 23' in a diametral direction. The retaining flange 24' has two ends which are formed with a pair of retaining notches 25'. Furthermore, the retaining flange 24' forms an appropriate angle with the keyway of the key plug 2.

The plug retaining sleeve 3 is formed with a pair of inwardly projecting curved flanges 37' disposed on two sides of the key groove 31'. During assembly, the key plug 2 and the plug retaining sleeve 3 are inserted into the lock shell 1 such that the retaining flange 24' is aligned with the key groove 31'. The key plug 2 is then rotated relative to the plug retaining sleeve 3, thereby enabling the curved flanges 37' to extend into the retaining notches 25' so as to engage rotatably the key plug 2 and the plug retaining sleeve 3. The key plug 2 can be removed from the lock shell 1 only when the retaining flange 24' is aligned with the key groove 31'. The construction and operation of the remaining parts of the fourth preferred embodiment are substantially similar to those of the previous embodiments and will not be detailed further.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A cylinder lock, comprising:

at least one first tumbler set, each of which including a lower tumbler pin and an upper tumbler pin;

a lock shell confining a cylindrical hole and having a front end and a rear end;

a rotatable cylindrical key plug provided within said hole of said lock shell via said front end of said lock shell and formed with a longitudinally extending keyway, said key plug having front and rear portions and being formed with at least one first bore which receives said lower tumbler pin of a respective said first tumbler set, each said first bore having an axis which is substantially normal to an axis of said key plug;

said lock shell being formed with at least one second bore which receives said upper tumbler pin of a respective said first tumbler set, each said second bore being aligned with a respective said first bore;

each said first tumbler set further including a spring for forcing said upper tumbler pin into a respective said first bore and for forcing said lower tumbler pin into said keyway to prevent rotation of said key plug relative to said lock shell;

a plug retaining sleeve having a front portion and a rear portion, said front portion of said plug retaining sleeve extending into said hole of said lock shell via said rear end of said lock shell and confining a hollow space for receiving said rear portion of said key plug;

said rear portion of said key plug and said front portion of said plug retaining sleeve being respectively formed with third and fourth radially aligned bores; and a second tumbler set having a lower tumbler pin received in said third and fourth bores;

said lower tumbler pin of said second tumbler set including a shank and a convex protrusion formed on one end of said shank;

said front portion of said plug retaining sleeve being formed with an L-shaped notch to access said fourth bore.

2. The cylinder lock as claimed in claim 1, wherein said lock shell is formed with a fifth bore which is aligned radially with said third bore of said key plug, and said second tumbler set further comprises an upper tumbler pin which is received in said fifth bore and a spring for forcing said upper tumbler pin into said third and fourth bores and for forcing said lower tumbler pin into said keyway.

3. The cylinder lock as claimed in claim 2, further comprising a key having a tumbler activating edge which is formed with at least one first key bit groove and a second key bit groove, each said first tumbler set being activated by a respective said first key bit groove when said key is inserted into said keyway such that a mating plane of said upper and lower tumbler pins of each said first tumbler set lies on a junction of said lock shell and said key plug, said second tumbler set being activated by said second key bit groove when said key is ,inserted into said keyway such that said upper tumbler pin of said second tumbler set extends into said fourth bore in said plug retaining sleeve, said shank of said lower tumbler pin extends fully into said third bore in said key plug, and such that said convex protrusion extends into said fourth bore, said key being operable so as to rotate said key plug relative to said plug retaining sleeve until said convex protrusion is moved from said fourth bore to reach one end of said L-shaped notch in order to permit removal of said key plug from said lock shell when said key is uprooted.

4. A cylinder lock, comprising:

at least one first tumbler set, each of which including a lower tumbler pin and an upper tumbler pin;

a lock shell confining a cylindrical hole and having a front end and a rear end;

a rotatable cylindrical key plug provided within said hole of said lock shell via said front end of said lock shell and formed with a longitudinally extending keyway, said key plug having front and rear portions and being formed with at least one first bore which receives said lower tumbler pin of a respective said first tumbler set, each said first bore having an axis which is substantially normal to an axis of said key plug;

said lock shell being formed with at least one second bore which receives said upper tumbler pin of a respective said first tumbler set, each said second bore being aligned with a respective said first bore;

each said first tumbler set further including a spring for forcing said upper tumbler pin into a respective said first bore and for forcing said lower tumbler pin into said keyway to prevent rotation of said key plug relative to said lock shell;

a plug retaining sleeve having a front portion and a rear portion, said front portion of said plug retaining sleeve extending into said hole of said lock shell via said rear end of said lock shell and confining a hollow space for receiving said rear portion of said key plug;

said rear portion of said key plug and said front portion of said plug retaining sleeve being respectively formed with third and fourth radially aligned bores; and a second tumbler set having a lower tumbler pin received in said third and fourth bores;

said plug retaining sleeve being formed with an axially extending key groove connected to said keyway of said key plug;

said lock shell being formed with a fifth bore which is aligned radially with said third bore of said key plug;

said second tumbler set further comprising an upper tumbler pin which is received in said fifth bore and a spring for forcing said upper tumbler pin into said third and fourth bores and for forcing said lower tumbler pin into said keyway;

said front portion of said key plug being formed with a first cylindrical section and a second cylindrical section which extends from said first cylindrical section and which has a diameter that is smaller than that of said first cylindrical section, said rear portion of said key plug being formed with a third cylindrical section which extends from said front portion of said key plug and which has a diameter that is smaller than that of said second cylindrical section and a tapered section which extends from said third cylindrical section;

said rear portion of said key plug being further formed with an axially extending retaining flange which extends from said tapered section in a diametral direction, said retaining flange being formed with at least one retaining notch and forming an angle with said keyway of said key plug.

5. The cylinder lock as claimed in claim 4, wherein said plug retaining sleeve is formed with at least one inwardly projecting curved flange disposed on one of two sides of said key groove, said curved flange extending into said retaining notch of said retaining flange so as to engage rotatably said key plug and said plug retaining sleeve, said key plug being removable from said lock shell only when said retaining flange is aligned with said key groove.

6. The cylinder lock as claimed in claim 4, wherein said second cylindrical section is formed with an inclined face adjacent to said third cylindrical section.

7. A cylinder lock, comprising:

at least one first tumbler set, each of which including a lower tumbler pin and an upper tumbler pin;

a lock shell confining a cylindrical hole and having a front end and a rear end;

a rotatable cylindrical key plug provided within said hole of said lock shell via said front end of said lock shell and formed with a longitudinally extending keyway, said key plug having front and rear portions and being formed with at least one first bore which receives said lower tumbler pin of a respective said first tumbler set, each said first bore having an axis which is substantially normal to an axis of said key plug;

said lock shell being formed with at least one second bore which receives said upper tumbler pin of a respective said first tumbler set, each said second bore being aligned with a respective said first bore;

each said first tumbler set further including a spring for forcing said upper tumbler pin into a respective said first bore and for forcing said lower tumbler pin into said keyway to prevent rotation of said key plug relative to said lock shell;

a plug retaining sleeve having a front portion and a rear portion, said front portion of said plug retaining sleeve extending into said hole of said lock shell via said rear end of said lock shell and confining a hollow space for receiving said rear portion of said key plug;

said rear portion of said key plug and said front portion of said plug retaining sleeve being respectively formed with third and fourth radially aligned bores; and a second tumbler set having a lower tumbler pin received in said third and fourth bores;

said plug retaining sleeve being formed with an axially extending key groove connected to said keyway of said key plug;

said lock shell being formed with a fifth bore which is aligned radially with said third bore of said key plug;

said second tumbler set further comprising an upper tumbler pin which is received in said fifth bore and a spring for forcing said upper tumbler pin into said third and fourth bores and for forcing said lower tumbler pin into said keyway;

said front portion of said key plug being formed with a first cylindrical section and a second cylindrical section which extends from said first cylindrical section and which has a diameter that is smaller than that of said first cylindrical section, said rear portion of said key plug being formed with a third cylindrical section which extends from said front portion of said key plug and which has a diameter that is smaller than that of said second cylindrical section and a tapered section which extends from said third cylindrical section;

said third cylindrical section being formed with a radial notch with a flat bottom, an inclined flat face extending from one side of said flat bottom of said radial notch, and a limiting wall portion disposed on one end of said radial notch opposite said second cylindrical section;

said front portion of said plug retaining sleeve being formed with a radial hole, said plug retaining sleeve further having a positioning pin retained in said radial hole, said positioning pin abutting against one of said flat bottom of said radial notch and said inclined flat face to limit rotation of said key plug relative to said plug retaining sleeve, said limiting wall portion restricting axial movement of said key plug relative to said plug retaining sleeve when said positioning pin extends into said radial notch.

8. The cylinder lock as claimed in claim 7, wherein said second cylindrical section is formed with an inclined face adjacent to said third cylindrical section.

9. The cylinder lock as claimed in claim 7, wherein said lock shell has front and rear end surfaces, and said plug retaining sleeve is formed with an annular peripheral flange between said front and rear portions thereof, said first cylindrical section of said front portion of said key plug and said annular peripheral flange on said plug retaining sleeve abutting respectively against said front and rear end surfaces of said lock shell.

10. The cylinder lock as claimed in claim 9, further comprising a first key having a longitudinal portion which extends into said key groove of said plug retaining sleeve and a tumbler activating edge which is formed with at least one first key bit groove and a second key bit groove, each said first tumbler set being activated by a respective said first key bit groove when said first key is inserted into said keyway such that a mating plane of said upper and lower tumbler pins of each said first tumbler set lies on a junction of said lock shell and said key plug, said second tumbler set being activated by said second key bit groove when said first key is inserted into said keyway such that a mating plane of said upper and lower tumbler pins of said second tumbler set lies on a junction of said lock shell and said plug retaining sleeve;

whereby, said first key permits simultaneous rotation of said key plug and said plug retaining sleeve relative to said lock shell when operated.

11. The cylinder lock as claimed in claim 10, further comprising a second key having a tumbler activating edge which is formed-with at least one first key bit groove and a second key bit groove, each said first tumbler set being activated by a respective said first key bit groove when said second key is inserted into said keyway such that the mating plane of said upper and lower tumbler pins of each said first tumbler set lies on the junction of said lock shell and said key plug, said second tumbler set being activated by said second key bit groove when said second key is inserted into said keyway such that the mating plane of said upper and lower tumbler pins of said second tumbler set lies on a junction of said key plug and said plug retaining sleeve;

whereby, said second key is operable so as to rotate said key plug relative to said plug retaining sleeve so that said positioning pin abuts against said inclined flat face and so that said limiting wall portion ceases to restrict the axial movement of said key plug relative to said plug retaining sleeve in order to permit removal of said key plug from said lock shell when said second key is extracted.

12. A cylinder lock, comprising:

at least one first tumbler set, each of which including a lower tumbler pin and an upper tumbler pin;

a lock shell confining a cylindrical hole and having a front end and a rear end;

a rotatable cylindrical key plug provided within said hole of said lock shell via said front end of said lock shell and formed with a longitudinally extending keyway, said key plug having front and rear portions and being formed with at least one first bore which receives said lower tumbler pin of a respective said first tumbler set, each said first bore having an axis which is substantially normal to an axis of said key plug;

said lock shell being formed with at least one second bore which receives said upper tumbler pin of a respective said first tumbler set, each said second bore being aligned with a respective said first bore;

each said first tumbler set further including a spring for forcing said upper tumbler pin into a respective said first bore and for forcing said lower tumbler pin into said keyway to prevent rotation of said key plug relative to said lock shell;

a plug retaining sleeve having a front portion and a rear portion, said front portion of said plug retaining sleeve extending into said hole of said lock shell via said rear end of said lock shell and confining a hollow space for receiving said rear portion of said key plug;

said rear portion of said key plug and said front portion of said plug retaining sleeve being respectively formed with third and fourth radially aligned bores; and a second tumbler set having a lower tumbler pin received in said third and fourth bores;

said plug retaining sleeve being formed with an axially extending key groove connected to said keyway of said key plug;

said lock shell being formed with a fifth bore which is aligned radially with said third bore of said key plug;

said second tumbler set further comprising an upper tumbler pin which is received in said fifth bore and a spring for forcing said upper tumbler pin into said third and fourth bores and for forcing said lower tumbler pin into said keyway;

said front portion of said key plug being formed with a first cylindrical section and a second cylindrical section which extends from said first cylindrical section and which has a diameter that is smaller than that of said first cylindrical section, said rear portion of said key plug being formed with a third cylindrical section which extends from said front portion of said key plug and which has a diameter that is smaller than that of said second cylindrical section and a tapered section which extends from said third cylindrical section;

said rear portion of said key plug being further provided with a fourth cylindrical section which extends axially from said tapered section, said fourth cylindrical section being formed with an annular peripheral groove adjacent to said tapered section and an axially extending peripheral notch which is connected to said peripheral groove.

13. The cylinder lock as claimed in claim 12, wherein said rear portion of said plug retaining sleeve is formed with a diametrically extending slit and an annular positioning groove which is connected to said slit.

14. The cylinder lock as claimed in claim 13, further comprising a C-shaped locking ring which is formed with an inward projection, said locking ring being provided in said positioning groove of said plug retaining sleeve such that said inward projection extends into said slit and into said annular peripheral groove of said fourth cylindrical section, said key plug being removable from said lock shell only when said inward projection is aligned with said peripheral notch.

15. The cylinder lock as claimed in claim 12, comprising a radial inward projection fixed relative to said plug retaining sleeve and extending into said annular peripheral groove of said fourth cylindrical section, said key plug being removable from said lock shell only when said inward projection is aligned with said peripheral notch.

16. The cylinder lock as claimed in claim 12, wherein said second cylindrical section is formed with an inclined face adjacent to said third cylindrical section.

* * * * *